US006860752B2

(12) United States Patent
McCoy et al.

(10) Patent No.: US 6,860,752 B2
(45) Date of Patent: Mar. 1, 2005

(54) ELECTRICAL CONNECTOR

(75) Inventors: Phillip McCoy, Albion, IN (US); John W. Burwell, Rome City, IN (US)

(73) Assignee: Dekko Technology, Inc., North Webster, IN (US)

( * ) Notice: Subject to any disclaimer, the term of this patent is extended or adjusted under 35 U.S.C. 154(b) by 82 days.

(21) Appl. No.: 10/115,205

(22) Filed: Apr. 2, 2002

(65) Prior Publication Data

US 2003/0184204 A1 Oct. 2, 2003

(51) Int. Cl.[7] ..... H01R 11/20
(52) U.S. Cl. ..... 439/441; 439/835; 439/397; 439/409
(58) Field of Search ..... 439/395, 397, 439/401, 402, 409, 440, 441, 834, 835, 413

(56) References Cited

U.S. PATENT DOCUMENTS 3,388,370 A * 6/1968 Elm ..... 439/402
3,629,794 A * 12/1971 Kourimsky ..... 439/440
3,979,615 A * 9/1976 Neff ..... 439/441
4,557,544 A * 12/1985 Esser ..... 439/441
5,772,464 A * 6/1998 Hohorst ..... 439/441
6,210,208 B1 * 4/2001 Barnes et al. ..... 439/441

* cited by examiner

*Primary Examiner*—Tho D. Ta
(74) *Attorney, Agent, or Firm*—Taylor & Aust, P.C.

(57) ABSTRACT

The invention comprises, in one form thereof, an electrical connector for connecting a first conductor and a second conductor, the first conductor and the second conductor both having an insulation coating and the second conductor having a stripped end, including a housing and an electrical terminal disposed with the housing. The electrical terminal includes at least one insulation displacement contact for electrical connection with the first conductor, and including at least one releasable pressure contact for connection and disconnection with the stripped end of the second conductor.

26 Claims, 2 Drawing Sheets

ELECTRICAL CONNECTOR

BACKGROUND OF THE INVENTION

1. Field of the Invention

The present invention relates to modular furniture, and, more particularly, to electrical connectors used in a modular furniture environment.

2. Description of the Related Art

In a modular furniture environment electrical connectors are used to electrically connect a variety of electrical appliances such as light fixtures and the like to electric utilities. Electrical connectors of known construction include connectors in which a conductor, with an end stripped of insulation, can have the stripped end inserted and removed from a terminal through a variety of terminal devices, requiring a form of disassembly or loosening of the connector. Also known are insulation displacement type electrical connectors in which a conductor can be connected to a connector terminal without making a physical break in the conductor so that the conductor can continue uninterrupted to another connector or electrical device.

During routine assembly and repair of electrical appliances such as light fixtures in a modular furniture environment, it is customary to make multiple connections to a common conductor such as the line or neutral conductors. One or more of these multiple connections may at sometime need to be released in order to effect the repair or rearranging of an electrical appliance. A problem with existing connectors is that they require a form of disassembly or loosening of the connector, requiring extra time or specialized skill, in order to disconnect the appliance. Additionally, it is desired to not interrupt the electrical connection to successive appliances during the repair or rearranging and a problem with existing connectors is that disconnecting one device may interrupt the electrical service to successive devices.

What is needed in the art is an electrical connector that provides for connecting to a conductor so that the stripped end can be inserted and removed from a terminal within the connector, without requiring disassembly or loosening of the connector, and a second conductor can make electrical connection to the same terminal without making a physical break in the second conductor.

SUMMARY OF THE INVENTION

The present invention provides an electrical connector with an electrical terminal disposed within a housing. The electrical terminal includes at least one insulation displacement contact and at least one releasable pressure contact.

The invention comprises, in one form thereof, an electrical connector for connecting a first conductor and a second conductor. The first conductor and the second conductor both have an insulation coating and the second conductor has a stripped end. An electrical terminal is disposed within a housing. The electrical terminal includes at least one insulation displacement contact for electrical connection with the first conductor, and includes at least one releasable pressure contact for connection and disconnection with the stripped end of the second conductor.

An advantage of the present invention is that the conductor with the stripped end can be inserted and removed from the electrical connector without the disassembly or partial disassembly of the electrical connector.

Another advantage is the first conductor can make electrical connection to the electrical terminal within the electrical connector without the need for terminating the conductor in the electrical connector.

Yet another advantage of the present invention is that the electrical connector facilitates easy assembly of an office furniture assembly.

Yet another advantage is the easy assembly of the electrical connector with the conductors.

Yet another advantage is the ability to easily remove an electrical device, for repair or replacement, from the electrical connector's releasable pressure contact.

Yet another advantage is the ability to remove an electrical device from the electrical connector's releasable pressure contact without disrupting electrical service to electrical devices connected to the pass-through conductor.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
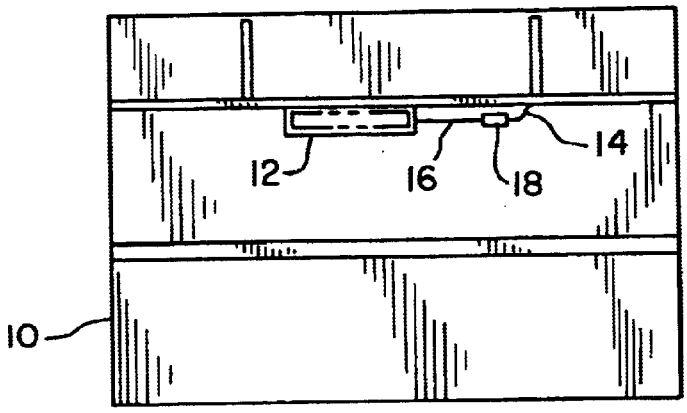
FIG. 1 is a perspective view of an office furniture assembly showing the electrical connector of the present invention connected with a light.

Referring now to the drawings, and more particularly to FIG. 1, there is shown an embodiment of an office furniture assembly 10 of the present invention, which generally includes an office furniture component 12, a first conductor 14, a second conductor 16 and an electrical connector 18. Office furniture component 12 is shown in FIG. 1 as a light fixture, but could alternatively be an electrical receptacle, speakers, telephone, fax machine, or other known electrical devices.

Figure 2:
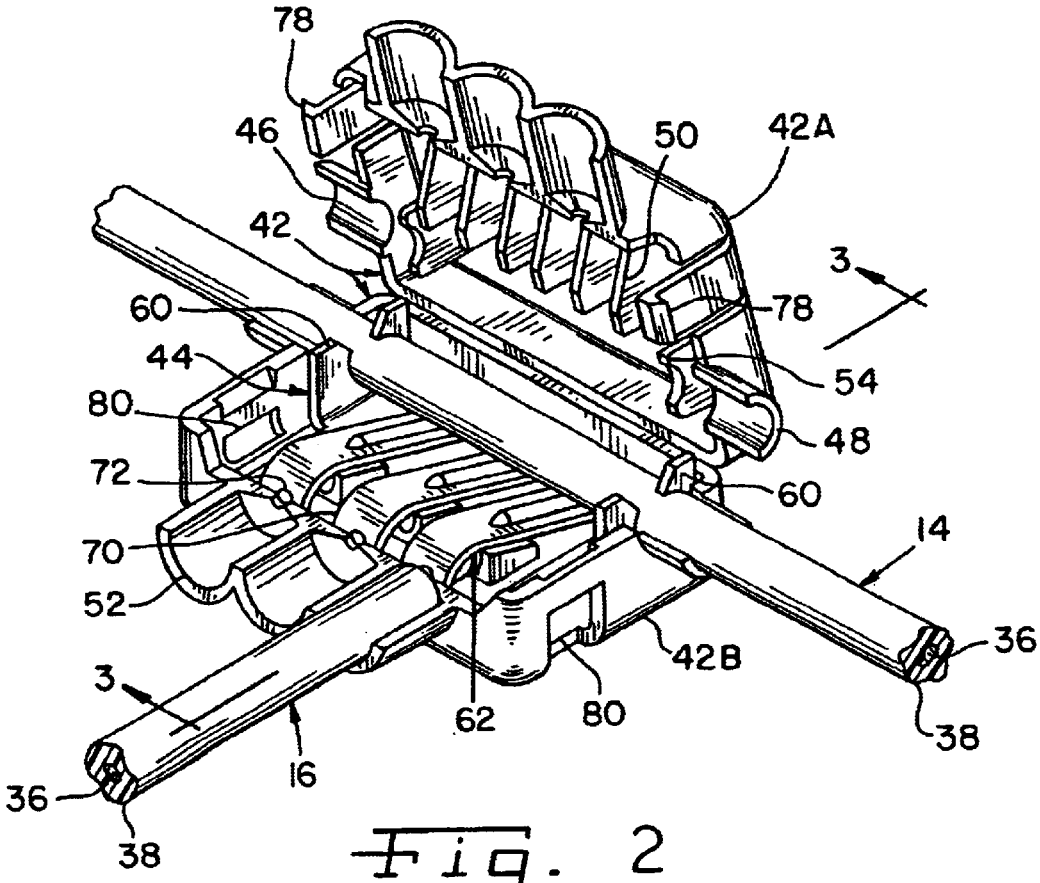
FIG. 2 is a perspective view of the electrical connector with one part of the housing partially opened.

First conductor 14 and second conductor 16 each include an inner conductor 36 surrounded coaxially by insulation 38 (FIG. 2). Second conductor 16 has stripped end 40 where insulation 38 has been removed from inner conductor 36. First conductor 14 carries a common electrical signal which is transferred to office furniture component 12 via second conductor 16 by making connection between first conductor 14 and second conductor 16 through electrical connector 18. Electrical connector 18 allows connection and disconnection of second conductor 16 without requiring disassembly of electrical connector 18, thereby making the assembly and servicing of office furniture component 12 easier.

Figure 3:
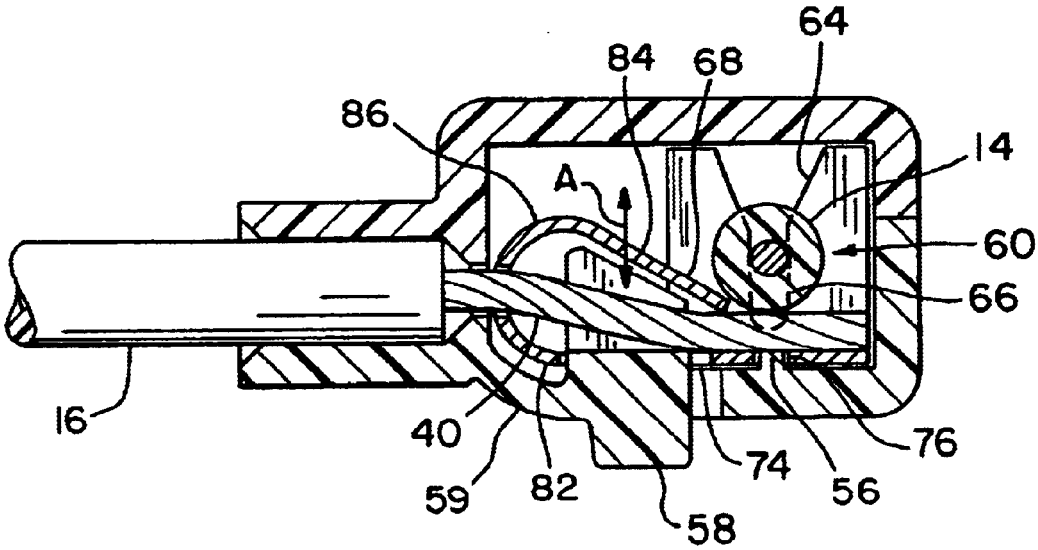
FIG. 3 is a sectional view taken along section line 3—3 in FIG. 2.

Electrical terminal 44 includes two insulation displacement contacts 60 and three releasable pressure contacts 62. Each insulation displacement contact 60 has V-shaped notch 64 (FIG. 3) which locates first conductor 14 with respect to straight notch 66. As first conductor 14 is pressed into V-shaped notch 64 and straight notch 66, straight notch 66 displaces insulation 38 thereby allowing inner conductor 36 of first conductor 14 to make electrical contact to insulation displacement contacts 60.

Releasable pressure contact 62 includes contact 68 which presses against and makes electrical contact with inner conductor 36 of stripped end 40 of second conductor 16 when second conductor 16 is inserted into wire aperture 72. Spring 70 of releasable pressure contact 62 forces contact 68 onto inner conductor 36 of second conductor 16 when second conductor 16 is inserted into wire aperture 72. Spring 70 includes first spline 82, second spline 84 and an interconnecting web 86 curved in an arc subtending greater than 180 degrees. Pushbutton aperture 74 allows pushbutton 58, when actuated, to allow second conductor 16 to make electrical contact with contact 68 or to be removed from contact 68 without the disassembly of electrical connector 18. Additionally, pushbutton 58, when actuated, allows the removal and/or insertion of second conductor 16 from connector 18 without other disassembly between second conductor 16 and terminal 44 such as unsoldering and resoldering, etc. Locating holes 76 of electrical terminal 44 allow registration and location of electrical terminal 44 with respect to housing 42.

Housing 42 generally includes apertures 46, 48 and 52 for the ingress and egress of conductors, housing clips 78 for holding housing halves 42A and 42B together, clip apertures 80 and pushbuttons 58. Electrical connector 18 has housing 42 with first aperture 46 allowing ingress of first conductor 14 and second aperture 48 allowing egress of first conductor 14. Alternatively, second aperture 48 can allow ingress of first conductor 14 and first aperture 46 can allow egress of first conductor 14. Aperture 52, in conjunction with pushbutton 58, allows for connection and disconnection of push-in second conductor 16 in electrical connector 18 without the disassembly of electrical connector 18. Housing clips 78 and clip apertures 80 allow housing 42 to be separated for the easy connection to pass-through first conductor 14. While housing 42 is shown as having housing halves 42A and 42B, it can alternatively be of monolithic construction.

FIG. 2 shows housing 42 with electrical terminal 44 mounted therein. Locating holes 76 of electrical terminal 44 are mounted over terminal locator pins 56 of housing 42 to allow registration and location of electrical terminal 44 with respect to housing 42. First conductor 14 is connected to insulation displacement contact 60 in a pass-through arrangement. Second conductor 16 is connected to releasable pressure contact 62 in a push-in arrangement.

Limit ribs 50 in housing 42 limit the maximum opening of releasable pressure contact 62. Wire support 54 of housing 42 supports first conductor 14 in insulation displacement contact 60 of electrical terminal 44.

Terminal locator pins 56 locate and hold electrical terminal 44 in housing 42. Push button 58 attaches to housing 42 through pushbutton resilient member 59 and actuates releasable pressure contact 62 thereby allowing connection and disconnection of second conductor 16 from electrical connector 18. Pushbutton 58 may actuate releasable pressure contact 62 (FIG. 3) in direction A to allow either the insertion or removal of second conductor 16.

During assembly electrical terminal 44 is mounted in housing 42. First conductor 14 is inserted into insulation displacement contacts 60 and then routed to subsequent devices and/or connectors. Housing halves 42A and 42B are closed causing insulation displacement contacts 60 to pierce insulation 38 and contact inner conductor 36. Stripped end 40 of second conductor 16 is then inserted into wire aperture 72. By actuating pushbutton 58, second conductor 16 can be fully inserted into and makes positive contact with releasable pressure contact 62 thereby completing the electrical connection between first conductor 14 and second conductor 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lighting fixture, comprising:

a light;

a first conductor and a second conductor associated with said light, said first conductor and said second conductor both having an insulation and said second conductor having a stripped end;

an electrical connector operatively coupled with said first conductor and said second conductor, said electrical connector including:

a housing including at least one wire support; and an electrical terminal disposed within said housing, said electrical terminal including at least one insulation displacement contact for both electrical connection with said first conductor and for at least one of piercing and displacing the insulation of said first conductor when said first conductor is compressed between said at least one wire support and said at least one insulation displacement contact, and including at least one releasable pressure contact for connection and disconnection with said stripped end of said second conductor.

2. The lighting fixture of claim 1, wherein said electrical terminal includes at least one locating hole for registration of said electrical terminal in said housing.

3. The lighting fixture of claim 1, wherein said at least one insulation displacement contact includes at least one V-shaped notch and at least one straight notch for displacing said insulation from said first conductor.

4. The lighting fixture of claim 1, wherein said at least one releasable pressure contact includes at least one contact for making contact with said stripped end of said second conductor.

5. The lighting fixture of claim 4, wherein each said releasable pressure contact includes a generally u-shaped spring.

6. A lighting fixture, comprising:

a light;

a first conductor and a second conductor associated with said light, said first conductor and said second conductor both having an insulation and said second conductor having a stripped end;

an electrical connector operatively coupled with said first conductor and said second conductor, said electrical connector including:

a housing; and an electrical terminal disposed within said housing, said electrical terminal including at least one insulation displacement contact for electrical connection with said first conductor, and including at least one releasable pressure contact for connection and disconnection with said stripped end of said second conductor, said at least one releasable pressure contact includes at least one contact for making contact with said stripped end of said second conductor, each said releasable pressure contact includes a generally u-shaped spring, each said releasable pressure contact includes a first spline, a second spline and an interconnecting web curved in an arc subtending greater than 180 degrees.

7. The lighting fixture of claim 6, wherein said housing has at least one pushbutton, and said first spline has a pushbutton aperture allowing said at least one pushbutton to actuate said second spline.

8. The lighting fixture of claim 7, wherein said web includes at least one wire aperture allowing the insertion of said stripped end of said second conductor into said electrical terminal.

9. A lighting fixture, comprising:

a light;

a first conductor and a second conductor associated with said light, said first conductor and said second conductor both having an insulation and said second conductor having a stripped end;

an electrical connector operatively coupled with said first conductor and said second conductor, said electrical connector including:

a housing; and an electrical terminal disposed within said housing, said electrical terminal including at least one insulation displacement contact for electrical connection with said first conductor, and including at least one releasable pressure contact for connection and disconnection with said stripped end of said second conductor, said at least one releasable pressure contact includes at least one contact for making contact with said stripped end of said second conductor, said housing includes at least one pushbutton for actuating said at least one releasable pressure contact.

10. The lighting fixture of claim 9, wherein said electrical terminal includes at least one pushbutton aperture for receiving said at least one pushbutton therein.

11. The lighting fixture of claim 9, wherein said at least one pushbutton includes at least one pushbutton resilient member.

12. An electrical connector for connection to a first conductor and a second conductor, the first conductor and the second conductor both having an insulation coating and the second conductor having a stripped end, said electrical connector comprising:

a housing including at least one wire support; and an electrical terminal disposed within said housing, said electrical terminal including at least one insulation displacement contact configured for both electrical connection with the first conductor and for at least one of piercing and displacing the insulation coating of the first conductor when said first conductor is compressed between said at least one wire support and said at least one insulation displacement contact, and including at least one releasable pressure contact configured for connection and disconnection with the stripped end of the second conductor.

13. The electrical connector of claim 12, wherein said housing is configured as a monolithic element.

14. An electrical connector for connection to a first conductor and a second conductor, the first conductor and the second conductor both having an insulation coating and the second conductor having a stripped end, said electrical connector comprising:

a housing; and an electrical terminal disposed within said housing, said electrical terminal including at least one insulation displacement contact for electrical connection with the first conductor, and including at least one releasable pressure contact for connection and disconnection with the stripped end of the second conductor, said housing has at least one actuating element for actuating said at least one releasable pressure contact.

15. The electrical connector of claim 14, wherein said at least one actuating element includes a pushbutton for actuating said at least one releasable pressure contact.

16. A method for electrically connecting a first conductor and a second conductor within an electrical connector, the first conductor and the second conductor both having an insulation and the second conductor having a stripped end, comprising the steps of:

providing said electrical connector with a housing including at least one wire support, and an electrical terminal disposed within said housing, said electrical terminal including at least one insulation displacement contact for both electrical connection with the first conductor and for at least one piercing and displacing the insulation coating of the first conductor when said first conductor is compressed between said at least one wire support and said at least one insulation displacement contact, and including at least one releasable pressure contact for connection with the stripped end of the second conductor;

coupling the stripped end of the second conductor with said at least one releasable pressure contact; and connecting the first conductor with said at least one insulation displacement contact.

17. The method of claim 16, wherein the first conductor is a pass-through conductor.

18. The method of claim 16, wherein the second conductor is a push-in conductor.

19. The method of claim 16, including the step of removing the second conductor from said electrical connector without the disassembly of said electrical connector.

20. An office furniture assembly, comprising:

an office furniture component;

a first conductor and a second conductor associated with said office furniture component, said first conductor and said second conductor both having an insulation and said second conductor having a stripped end;

an electrical connector operatively coupled with said first conductor and said second conductor, said electrical connector including:

a housing including one wire support; and an electrical terminal disposed within said housing, said electrical terminal including at least one insulation displacement contact for both electrical connection with said first conductor and for at least one of piercing and displacing the insulation of said first conductor when said first conductor is compressed between said at least one wire support and said at least one insulation displacement contact, and including at least one releasable pressure contact for connection and disconnection with said stripped end of said second conductor.

21. The office furniture assembly of claim 20, wherein said office furniture component is a light.

22. The office furniture assembly of claim 20, wherein said first conductor is a pass-through conductor.

23. The office furniture assembly of claim 20, wherein said second conductor is a push-in conductor.

24. The office furniture assembly of claim 20, wherein said housing is configured as a monolithic element.

25. An office furniture assembly comprising:

an office furniture component;

a first conductor and a second conductor associated with said office furniture component, said first conductor and said second conductor both having an insulation and said second conductor having a stripped end;

an electrical connector operatively coupled with said first conductor and said second conductor, said electrical connector including:

a housing; and an electrical terminal disposed within said housing, said electrical terminal including at least one insulation displacement contact for electrical connection with said first conductor, and including at least one releasable pressure contact for connection and disconnection with said stripped end of said second conductor, said housing has at least one actuating element for actuating said at least one releasable pressure contact.

26. The office furniture assembly of claim 25, wherein said at least one actuating element includes at least one pushbutton for actuating said at least one releasable pressure contact.

* * * * *

UNITED STATES PATENT AND TRADEMARK OFFICE

CERTIFICATE OF CORRECTION

PATENT NO. : 6,860,752 B2
DATED : March 1, 2005
INVENTOR(S) : McCoy et al.

It is certified that error appears in the above-identified patent and that said Letters Patent is hereby corrected as shown below:

Title page,
Item [73], Assignee, delete "Dekko Technology, Inc.", and substitute -- Dekko Technologies, Inc. --.

Signed and Sealed this

Tenth Day of January, 2006

JON W. DUDAS
*Director of the United States Patent and Trademark Office*